United States Patent [19]

Sakota

[11] 4,016,665

[45] Apr. 12, 1977

[54] SIGNBOARD USING MARCROMOLECULAR ELASTOMER HAVING ADHESIVE LAYER

[76] Inventor: Mitsushi Sakota, 4-9-8, Kibogaoka, Chikusa, Nagoya, Japan

[22] Filed: July 25, 1975

[21] Appl. No.: 599,172

[30] Foreign Application Priority Data

July 31, 1974 Japan ..... 49-88384
June 21, 1975 Japan ..... 50-76302

[52] U.S. Cl. ..... 40/135
[51] Int. Cl.[2] ..... G09F 7/00
[58] Field of Search ..... 40/135, 134, 125 A, 40/22, 125 F; 428/356, 351, 354, 914

[56] References Cited

UNITED STATES PATENTS

| | | | |
|---|---|---|---|
| 1,617,707 | 2/1927 | Geer | 40/2 R X |
| 2,094,428 | 9/1937 | Fulton | 40/135 X |
| 2,354,018 | 7/1944 | Heltzer et al. | 40/135 X |
| 2,383,884 | 8/1945 | Palmquist | 40/135 X |
| 2,407,680 | 9/1946 | Palmquist et al. | 40/135 X |
| 2,880,542 | 4/1959 | Butterweich | 40/135 X |
| 3,129,816 | 4/1964 | Bond et al. | 428/356 |

*Primary Examiner*—Russell R. Kinsey
*Assistant Examiner*—Wenceslao J. Contreras
*Attorney, Agent, or Firm*—Robert E. Burns; Emmanuel J. Lobato; Bruce L. Adams

[57] ABSTRACT

A signboard is provided which is comprised of a flexible weather-proof macromolecular sheet, a colored paint coated on the front surface of the sheet in the form of a design or message and a self-sticking adhesive layer containing rubber and bituminous material on the back surface of the sheet. The signboard may be stuck readily to substantially any surface to convey a message therefrom and it then forms a protective coating on the surface to which it is stuck. The signboard may also contain a luminous layer composed of glass granules and a transparent finish on the front surface of the sheet whereby the message or design may be seen readily, even at night, by reflected light.

14 Claims, 10 Drawing Figures

SIGNBOARD USING MARCROMOLECULAR ELASTOMER HAVING ADHESIVE LAYER

BACKGROUND OF THE INVENTION

This invention relates to a signboard which may be used as a traffic signal, danger signal, bumper sticker, billboard and the like, wherein a readily visible message is conveyed by means of letters, figures, symbols, etc. More particularly, this invention concerns a signboard which has a surface of weatherproof elastic or flexible, macromolecular material and a backing layer of adhesive containing bituminous material, whereby the signboard may be readily attached and firmly stuck along a curved, plain, angular or gently uneven surface.

Conventional signs and billboards useful for traffic signals, advertisement and so forth are often made by coating iron plates with paint or by directly painting particular areas, such as posts, road or the like with guiding signs. In the case of a metal plate, the material cost is generally high and moreover, the metal sign must be attached to some sort of pole, which is particularly uneconomical with respect to the high cost labor involved, as well as the required accessories, such as metal bands, nuts and bolts and the jigs and the tools used by the worker. The worker's burden is substantial and there is danger of injury. In addition, these materials are susceptible to rust, particularly if damaged by surface scratching and peeling of paint. Therefore such signs must be replaced about every three to five years. Also, such signs can cause damage to a contacting object, such as a car and in certain circumstances pedestrians may be injured with a sharp projecting part of a sign or billboard. Due to conductivity, such signs and billboards are unsuitable for use in places where they may come in contact with electricity; this can happen for example, if the sign slips out of its specified position after it has been attached, due to the loosening of the nuts and bolts.

If the sign has an unusual shape, there are the added disadvantages of the requirement of a large storage space, as well as of transportation of bulky weight cargo, in a way which avoids scratching the coating.

In the particular situation where the sign is painted when in place, the cost is even higher, because operators must then work in the field, and, according to the traffic situation, it may be necessary to carry out the work within a short period of low traffic flow, at night, or to temporarily decrease, or shut off the traffic flow, which of course is highly inconvenient.

When the signal is provided with a luminous tape, the disadvantages include the very high expense of the tape and the labor involved.

SUMMARY OF THE INVENTION

A principal object of the present invention is to provide a signboard which is long-lasting, easy to apply and economical, and thus avoids the disadvantages mentioned above.

Another object of this invention is to provide a signboard having a macromolecular elastomeric or flexible layer, suitable for signs such as billboards, stickers and similar signs which contain advertisements, traffic signals and the like indicated by letters, figures and/or symbols.

A further object of this invention is to provide a signboard having a macromolecular elastomeric layer suitable for displaying letters, figures, symbols and all types of messages by means of a luminous-coated layer which may be clearly seen, even at night.

Another object of the present invention is to provide a signboard having a macromolecular elastomeric layer which is capable of sticking tightly along a plain surface, curved surface, angular surface and a gently uneven surface.

Still another object of the present invention is to provide a signboard having a macromolecular elastomeric layer which is capable of being applied readily by any individual to a desired display surface and which may be cut readily to an optional size and shape.

Another object of the present invention is to provide a signboard having a macromolecular elastomeric surface, wherein various desirable characteristics for a signboard are combined, including the characteristics of being water-proof, electrically insulating, durable in all kinds of weather, elastic, readily visible and economical.

According to the present invention, the signboard is comprised of a weather-proof macromolecular flexible sheet substantially composed of rubber or synthetic resin, colored paint coated on the surface of the elastic sheet and a self-sticking adhesive layer composed principally of bituminous material and rubber on the back of the flexible sheet.

In a preferred embodiment of the present invention, the signboard further comprises a layer of glass granules and a transparent finish which coats the glass granules.

DESCRIPTION OF THE PREFERRED EMBODIMENTS

Figure 1:
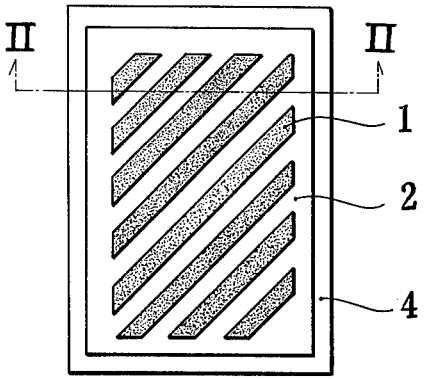
FIG. 1 is a plan view showing a signboard of the inventive which may be applied as a protective plate to a support and having oblique strips useful as a warning sign.

In one embodiment of this invention, the signboard is comprised of a macromolecular sheet which has weatherproof and elastic or flexible characteristics, a coating of colored paint on the surface of the macromolecular sheet and on the backside of the macromolecular sheet, an adhesive layer which is capable of self-adhesion, i.e. it adheres to the macromolecular sheet and substantially any supporting surface to which it is applied and is comprised principally of a bituminous material.

The macromolecular elastomeric sheet used in the signboard of the present invention is approximately 0.20 mm. to 10.00 mm. thick. A flexible anti-weathering type of rubber or vinyl chloride polymer sheet is preferably used. Examples of suitable materials include ethylene-propylene-diene-terpolymer (EPT or EPDM), isobutylene-isoprene rubber (IIR), chloroprene rubber (CR), chlorosulfonated polyethylene, natural rubber (NR) isoprene rubber (IR), acrylonitrile-vinylchloride copolymer and blends thereof, such as a blend of EPT and IIR. The adhesive layer is preferably composed principally of a bituminous material such as asphalt in combination with synthetic and/or natural rubber.

According to the invention, the adhesive layer may have the following composition:

| | |
|---|---|
| butyl reclaimed rubber | 0 to 100 parts |
| natural rubber, styrene-butadiene rubber (SBR), or reclaimed rubber | 100 to 0 parts |
| asphalt | 50 to 250 parts |
| clay | 300 to 0 parts |
| calcium bicarbonate | 0 to 300 parts |
| plasticizer (DOP) | 0 to 100 parts |

An adhesive accelerator, in an amount of 0 to 100 parts may also be included in the adhesive composition; such accelerators include, polybutene, polyisobutylene, cumarone resin, terpene resin, xylene resin and poly(methyl methacrylate).

This adhesive composition is very inexpensive, compared to other adhesive compositions having an equal binding capacity and the binding strength is high and durable for concrete, wood and metal due to the presence of the bituminous materials.

In this embodiment of the invention, any type of colored paint may be used to form the desired design, message or the like on the surface side. An example of a paint which has found to be particularly useful is yellow III - 7, a product of the Japanese firm, SAKAI CHEMICALS CO., LTD.

In another embodiment of the signboard of the present invention, the surface of the macromolecular sheets which contains a coating of colored paint is further coated with a luminous layer composed of luminescent glass grains or granules which emit reflecting light in response to the light of cars, so that even at night the colored paint of the signboard is clearly visible. The luminous layer also includes a transparent finish which is a transparent varnish or paint, which covers the glass grains and causes them to stick to the painted or unpainted surface of the elastic sheet.

The glass granules or beads used in the signboard of the invention ordinarily have a high refractive index, i.e. about 0.0058 – 0.0015 and are about 100 – 400 mesh in size, (0.147 mm. to 0.037 mm.). An example of such glass are the BRIGHT GLASS BEADS, type 200 mesh, UB - 67 H, produced by UNION GLASS INDUSTRY CO., LTD., in Japan.

the transparent coating or finish which is applied to the glass granules is desirably a varnish of the urethane family, however other types of transparent finishes may be used. Among the transparent finishes of the urethane family, the following may be mentioned in particular; the moisture-hardening type, such as Wankan, manufactured by Mikuni Paint Co., Ltd.; the two-liquid hardening type or two-pot system type, including those hardened by polyol and by isocyanate prepolymer, for example Clean 4015, produced by Sakai Kagaku Co., Ltd. and the urethane resin type (thermolastic urethane), diluted with solvent, such as Honnythane 622-1, produced by Hirono Chemical Co., Ltd. Japan.

Other transparent finishes used on the signboard of the present invention include those produced with EPT, including the graft polymerization products of EPT with acrylic monomer and with vinyl monomer, such as Clean E-15, produced by Sakai Kagaku Co., Ltd.; transparent acrylic resin finishes, such as poly(-methyl methacrylate) and acrylic rubber finishes, for example, Clean SV-8 produced by Saai Kagaku Co., Ltd.; transparent finishes involving the use of graft polymerization products of: SBR and vinyl monomer, such as Sakai Lac 3200; of natural rubber and vinyl monomer, such as Sakai Lac 3000 and of IR and vinyl monomer, such as Saai Lac 3050, all produced by Sakai Kagaku Co., Ltd. in Japan.

According to the present invention, the signboards discussed above may be formed in a particular shape and with any type of message, such as a particular article of commerce, name of a commodity, trademark, service mar, name of a company and the like. The invention will now be further described with reference to the drawings and particular examples thereof, which illustrate the best mode currently contemplated for carrying out the invention, but must not be construed as limiting the invention in any manner.

EXAMPLES

Example 1

With reference to FIG. 1, which illustrates a signboard of the invention, the luminous layer 1 is coated on a weather-proof macromolecular sheet 2, about 0.7 mm. thick made of flexible rubber or vinyl chloride polymer to form bright diagonal stripes. The adhesive layer 3, which is seen more clearly in FIG. 2, which is a sectional view of FIG. 1 taken along the lines II—II and FIG. 3, which is a partial enlarged view of the cross-section is coated on the backside of the macromolecular sheet 2. A sheet of paper 4, which is peeled off when the signboard is fixed to a permanent support is mounted on the back surface of the adhesive to prevent premature sticking.

Figure 9:
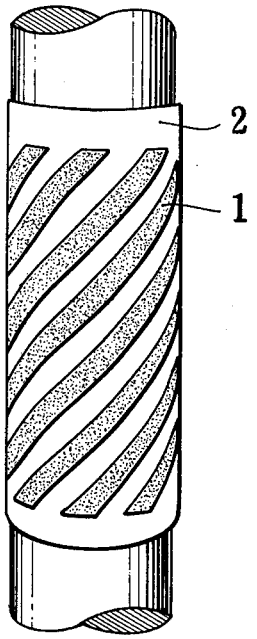
FIG. 9 is a vertical elevation of the principal parts of the signboard of FIG. 1 after it has been applied and stuck on a cylinder support.
Figure 10:
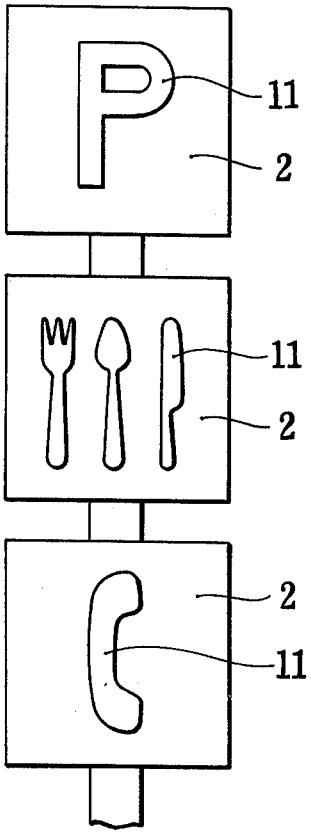
FIG. 10 is a front view of a billboard wherein signboards of the present invention containing symbols are used.

The use of this signboard as a protective plate is shown in FIG. 9 where it is shown firmly fixed to an electric light pole.

Figure 2:
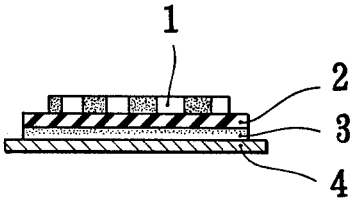
FIG. 2 is a vertical sectional view along II—II of FIG. 1.
Figure 3:
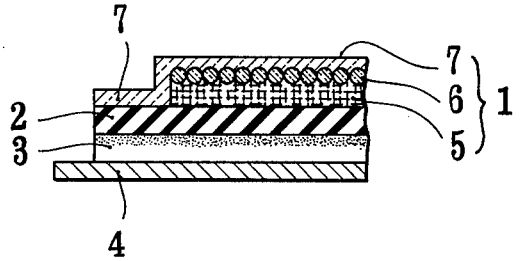
FIG. 3 is a partial enlarged view of FIG. 2.

The signboard illustrated in FIGS. 1, 2 and 3 is prepared by laminating on a macromolecular elastic sheet of rubber or vinyl chloride an adhesive layer 3 having the following composition:

| | |
|---|---|
| Butyl reclaimed rubber | 50 Parts |
| Natural rubber or SBR reclaimed rubber | 50 Parts |
| Asphalt | 200 Parts |
| Clay | 50 Parts |
| Calcium bicarbonate | 50 Parts |
| Plastic agent DOP | 30 Parts |
| Adhesives Accelerator | 30 Parts |

The laminated adhesive layer is then lined with a sheet of peel-off paper 4 and reel.

The luminous-coated layer 1 is then applied to the surface of an unvulcanized or vulcanized macromolecular elastic sheet 2. With reference to FIG. 3, a coat of paint 5, such as yellow III - 7, produced by Sakai Chemicals Co., Ltd. Japan is applied in the desired striped design. Then glass beads 6 are scattered on the paint 5 and covered by a transparent finish 7, namely a varnish of the urethane family; under such semi-drying conditions, the glass grains stick to the surface of the elastic sheet 2. When the macromolecular elastic sheet 2 is rubber, the luminous coated layer 1 may be applied either before vulcanization, after calendar rolling of the rubber sheet, before lamination of binding layer 3 or after vulcanization; that is, the most economical method may be selected after consideration of the size and quantity of the product to be manufactured and the facilities available.

For a sign which does not require a luminous-coated layer, any type of paint desired may be employed to form the coated layer 1 (or 5).

This signboard can be attached easily, simply by sticking it to the surface of a specified object, after peeling off the paper 4 from the underside. For example, this signboard can be stuck along a plain wall surface, a curved surface or the corner part of a wall surface, so that the sign is bent at a right angle, or around a circumferential surface like an electric light pole.

Due to the elasticity and flexibility of the macromolecular elastic sheet 2, even if cars bump into the signboard, it can be restored to its original state and damage to the car and to the signboard is substantially reduced or possibly, avoided altogether.

Due to its weather-proof characteristics, the present signboard has a long, durable life even outdoors, exposed to wind, rain and the like and there is of course no problem with respect to electric insulation. Further, the signboard of the invention can be stuck to a multidirectional support, by bending the sign in the vertical, horizontal etc . . . direction.

Example 2

Figure 4:
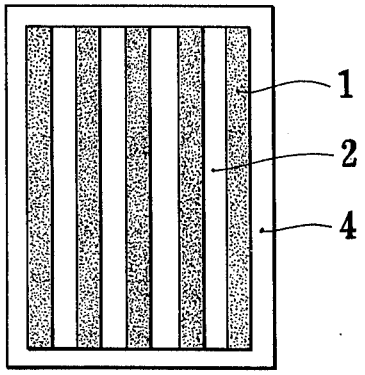
FIG. 4 is a plan view of another example of a signboard of the invention which may be applied as a protective plate to a support and having vertical stripes, useful as a warning signal.

With reference to FIG. 4, the luminous-coated layer 1 which is prepared in the same manner as in Example 1, is arranged in a vertical striped pattern. The macromolecular elastic sheet 2 has been laminated with an adhesive layer 3 having the following composition:

| | |
|---|---|
| Butyl reclaimed rubber | 70 Parts |
| Natural rubber or SBR reclaimed rubber | 30 Parts |
| Asphalt | 50 Parts |
| Clay | 200 Parts |
| Calcium bicarbonate | 200 Parts |
| Plastic agent DOP | 50 Parts |
| Adhesives Accelerator | 50 Parts |

The method of constructing and applying the signboard of the invention is the same as that described under Example 1.

Example 3

Figure 5:
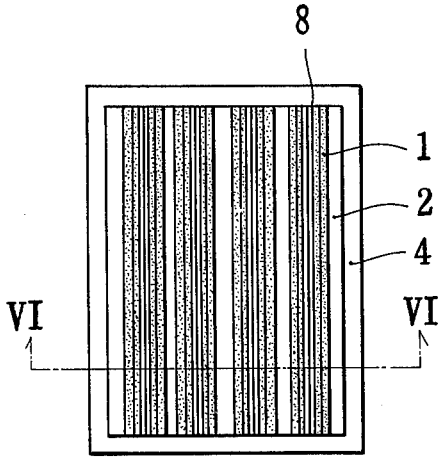
FIG. 5 is a plan view of still another example of a signboard of the present invention which may be applied as a protective plate to a support and which has a somewhat different structure from the previously illustrated signboards.
Figure 6:
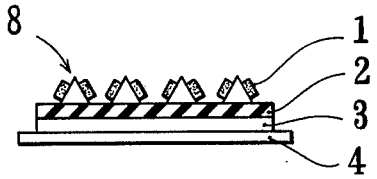
FIG. 6 is a sectional view along the line VI—VI of FIG. 5.

Figure 5 illustrates an example of a signboard of the invention useful as a protective plate, which is particularly suitable for the protection of the corner of a road or an object, such as an electric light pole standing nearby. With reference to FIG. 6, which is a sectional view of FIG. 5 taken along the lines VI—VI, the luminous-coated layer 1 is laterally arranged on the macromolecular elastomer 8, having a triangular shape and reranged in parallel. The slanting surfaces of the elastomer 8 are coated with colored paint and covered with glass beads and a transparent finish.

This signboard is prepared by sticking on the sheet 2, the triangular-shaped elastomers 8, which are produced by extrusion, compression or injection molding processes usual for processing such resins; alternately, the elastomeric sheet having the macromolecular elastomers 8 thereon is plasticized in one body. The method of applying the luminous layer and the adhesive backing is the same as that described in Example 1.

Example 4

Figure 7:
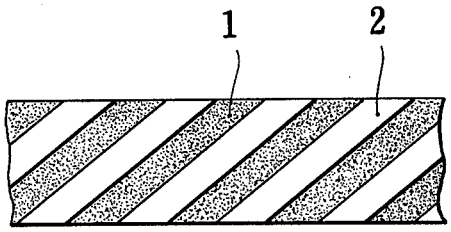
FIG. 7 is a partial plan view of a striped signboard of the invention.

An example of a signboard of the present invention which provides increased safety and which may be applied easily to a guard rail for a curving road or ledge is illustrated in FIG. 7. Such belt-type narrow products can be applied to the front stairs, on the pathway of crowded stations. Since it is easy to cut, there is the added advantage of being able to cut the signboard to an optional shape, length and so forth.

Example 5

Figure 8:
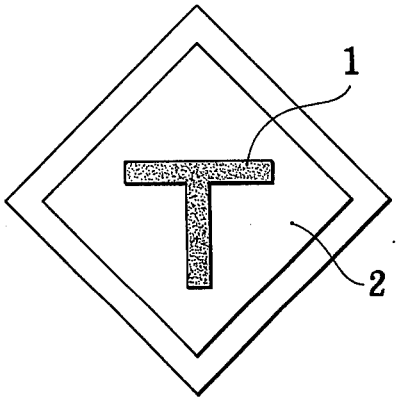
FIG. 8 is a plan view of an example of a signboard of the present invention useful as a traffic signal.

An example of a signboard of the present invention carrying a warning road sign, indicating a T-shaped road is illustrated in FIG. 8. This road sign can be manufactured by applying a signboard of the present invention on both surfaces of a base support which may be made of ordinary materials such as metal or wood. However, the signboard of the present invention provides a flexible and weather-proof protective covering for the base support and is particularly advantageous thereby.

The signboards of the present invention can also be applied to a support to indicate the locations of a service station, drive-in, toilet and telephone booths on a roadway; likewise, the product of the present invention may be formed into various symbols, for example service marks, company marks, firm name, trademarks, and symbols indicating service stations, advertising oil companies, beverages, cosmetics and the like. Further, the signboard of the present invention may be applied to billboards and used for mass advertisement on labels and stickers.

As examples of applications of the signboard of the invention, there are traffic signboards, road signboards, warning signboards, notice signboards, danger signboards, commercial information signboards, billoards, notice boards, construction signboards and the use of stickers and labels showing symbols and other signs.

The signboards of the invention can be applied to road facilities, such as demarcating lines, parking places, crossings, platforms, fences for construction, safety zones, pedestrian bridges, tunnels and bridges and factory facilities, cars, ships, buoys, fork lifts, conveyors, substations, inside and outside danger facilities, such as gas bombs, gas tanks and high voltage cables, stadiums, service stations, automatic vending equipment for tobacco etc. and every other facility and article which may be painted with figures, designs, letters or symbols, including underground cables and reflecting mirrors and door mats. It must be particularly mentioned that the products of the invention, such as those disclosed in Examples 1 through 4 are particularly expensive to manufacture compared to similar signs made of metals, such as iron. Moreover, if a base black cover sheet is used, the painting of a black color may be eliminated which further reduces the cost of some signs.

In applying the present signboard, the macromolecular flexible sheet containing the adhesive and coated surface may be durably fixed to a support, merely by peeling the paper from the adhesive layer and pressing the adhesive layer to the support by hand. No special skill or special tools are required. Thus, the application is especially simple and inexpensive.

The present signboard can be stuck suitably to a support having substantially any curvature, in contrast to metal which is difficult to deform and to apply to a curved surface. Likewise, if a collision occurs with a signboard of the invention, there is little damage to the contacting objects and there is substantially no risk of injury to pedestrians. Also, as previously mentioned, the signboards of the invention are anti-corrosive and in fact protect the support material to which they are applied, due to their water -proof, anti-acid and insulating characteristics. There is also no damage to an object to which the present signboard is attached and the durability thereof is approximately more than twice that of a signboard made of metal.

The present signboards also are advantageous with respect to storage and transportation, since there is no need or risk of bending, scratching or the like and the storage space required is minimal and transportation is easy.

The present signboards are particularly advantageous for use under severe environmental conditions, such as storms and salt, on mountain roads and benches.

What I desire to claim and protect by letters patent is:

1. A signboard which can be applied to substantially any type of surface which comprises a flexible antiweathering macromolecular sheet composed of rubber or synthetic resin, a colored paint coated on the front surface of said sheet to form a design or message and a self-sticking adhesive on the back surface of said sheet composed principally of a mixture of rubber and asphalt.

2. A signboard according to claim 1 wherein said sheet is composed of a material selected from at least one member of the group consisting of natural rubber, synthetic rubber and vinyl chloride polymer.

3. A signboard according to claim 1 which further comprises a luminous layer on the front surface of said sheet comprised of glass granules and a transparent finish which coats said granules and causes said granules to stick to said sheet.

4. A signboard according to claim 3 wherein said transparent finish is a transparent varnish or paint of the urethane family.

5. A signboard according to claim 3 wherein said transparent finish is a transparent varnish selected from types of varnish consisting of ethylene-propylene-terpolymer, acrylic resin, and the graft polymerization product of styrenebutadiene rubber and vinyl monomer, of natural rubber and vinyl monomer and of isoprene rubber and vinyl monomer.

6. Label comprised of the signboard defined in claim 3.

7. Message carrying billboard comprised of the signboard defined in claim 3.

8. Label comprised of the signboard defined in claim 1.

9. Message carrying billboard comprised of the signboard defined in claim 1.

10. A signboard according to claim 1 wherein said adhesive contains about 50 to 200 parts by weight of said rubber per 100 parts by weight of said asphalt.

11. A signboard according to claim 1 in which said self-sticking adhesive contains, in parts by weight, 50 to 250 parts of asphalt, 0 to 100 parts of reclaimed butyl rubber, 0 to 100 parts of a rubber selected from a memer of the group consisting of natural rubber, styrene-butadiene rubber and reclaimed rubber, 0 to 300 parts of clay, 0 to 300 parts of calcium bicarbonate and 0 to 100 parts of plasticizer.

12. A signboard according to claim 11 in which said adhesive contains in parts by weight, about 50 to 70 parts of reclaimed butyl rubber, about 30 to 50 parts of natural rubber of styrenebutadiene reclaimed rubber and about 50 to 200 parts of asphalt.

13. A signboard according to claim 1 in which said sheet consists of rubber.

14. A signboard according to claim 1 in which said sheet consists of a synthetic resin of vinyl chloride polymer.

* * * * *